US008746367B2

(12) United States Patent
DiGiovanni et al.

(10) Patent No.: US 8,746,367 B2
(45) **Date of Patent: *Jun. 10, 2014**

(54) APPARATUS AND METHODS FOR DETECTING PERFORMANCE DATA IN AN EARTH-BORING DRILLING TOOL

(75) Inventors: Anthony A. DiGiovanni, Houston, TX (US); Eric C. Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 260 days.

This patent is subject to a terminal disclaimer.

(21) Appl. No.: 13/093,284

(22) Filed: Apr. 25, 2011

(65) Prior Publication Data

US 2011/0266055 A1 Nov. 3, 2011

Related U.S. Application Data

(60) Provisional application No. 61/408,119, filed on Oct. 29, 2010, provisional application No. 61/408,106, filed on Oct. 29, 2010, provisional application No. 61/328,782, filed on Apr. 28, 2010, provisional application No. 61/408,144, filed on Oct. 29, 2010.

(51) Int. Cl.

| | |
|---|---|
| ***B23P 17/04*** | (2006.01) |
| ***E21B 10/36*** | (2006.01) |
| ***E21B 49/00*** | (2006.01) |
| ***E21B 10/08*** | (2006.01) |

(52) U.S. Cl.
CPC ..... *E21B 10/08* (2013.01)
USPC ..... 175/50; 175/428; 29/592.1

(58) Field of Classification Search
USPC ..... 175/50, 428, 39, 327, 374, 433; 29/592.1, 599, 612, 620
See application file for complete search history.

(56) References Cited

U.S. PATENT DOCUMENTS 4,645,977 A 2/1987 Kurokawa et al.
4,707,384 A 11/1987 Schachner et al.

(Continued)

FOREIGN PATENT DOCUMENTS

JP 11101091 A * 4/1999
JP 2000225511 A 8/2000

OTHER PUBLICATIONS

Battaglia, J. et al., "Estimation of Heat Fluxes During High-Speed Drilling," Int. Jnl. Adv. Manf. Technol., vol. 26, pp. 750-758 (2005).

(Continued)

*Primary Examiner* — Daniel P Stephenson
(74) *Attorney, Agent, or Firm* — Cantor Colburn LLP

(57) ABSTRACT

Methods and associated tools and components related to generating and obtaining performance data during drilling operations of a subterranean formation is disclosed. Performance data may include thermal and mechanical information related to earth-boring drilling tool during a drilling operation are disclosed. For example, a cutting element of an earth-boring drilling tool may include a substrate with a cutting surface thereon. The cutting element may further include at least one thermistor sensor coupled with the cutting surface, and a conductive pathway operably coupled with the at least one thermistor sensor. The at least one thermistor sensor may be configured to vary a resistance in response to a change in temperature. The conductive pathway may be configured to provide a current path through the at least one thermistor sensor in response to a voltage. Other methods, tools and components are provided.

16 Claims, 5 Drawing Sheets

(56) References Cited

U.S. PATENT DOCUMENTS

| | | | | |
|---|---|---|---|---|
| 4,785,894 | A * | 11/1988 | Davis et al. | 175/39 |
| 4,976,324 | A | 12/1990 | Tibbitts | |
| 5,066,938 | A | 11/1991 | Kobashi et al. | |
| 5,317,302 | A | 5/1994 | Yamazaki | |
| 5,337,844 | A | 8/1994 | Tibbitts | |
| 5,512,873 | A | 4/1996 | Saito et al. | |
| 5,523,121 | A | 6/1996 | Anthony et al. | |
| 5,706,906 | A | 1/1998 | Jurewicz et al. | |
| 5,881,830 | A | 3/1999 | Cooley | |
| 6,068,070 | A | 5/2000 | Scott | |
| 6,274,403 | B1 | 8/2001 | Klages et al. | |
| 6,571,886 | B1 | 6/2003 | Sullivan et al. | |
| 6,612,384 | B1 * | 9/2003 | Singh et al. | 175/341 |
| 6,626,251 | B1 | 9/2003 | Sullivan et al. | |
| 7,052,215 | B2 * | 5/2006 | Fukano | 407/113 |
| 7,066,280 | B2 | 6/2006 | Sullivan et al. | |
| 7,338,202 | B1 | 3/2008 | Kapat et al. | |
| 7,604,072 | B2 * | 10/2009 | Pastusek et al. | 175/40 |
| 7,697,375 | B2 | 4/2010 | Reiderman et al. | |
| 7,946,357 | B2 | 5/2011 | Trinh et al. | |
| 8,195,438 | B2 * | 6/2012 | Singh et al. | 703/6 |
| 2004/0069539 | A1 * | 4/2004 | Sullivan et al. | 175/337 |
| 2004/0184700 | A1 * | 9/2004 | Li et al. | 385/12 |
| 2005/0230149 | A1 * | 10/2005 | Boucher et al. | 175/48 |
| 2006/0018360 | A1 | 1/2006 | Tai et al. | |
| 2007/0056171 | A1 | 3/2007 | Taryoto | |
| 2007/0092995 | A1 * | 4/2007 | Datta et al. | 438/108 |
| 2008/0257730 | A1 * | 10/2008 | Jiang et al. | 204/412 |
| 2009/0114628 | A1 | 5/2009 | DiGiovanni | |
| 2010/0038136 | A1 * | 2/2010 | Trinh et al. | 175/40 |
| 2010/0078216 | A1 | 4/2010 | Radford et al. | |
| 2010/0083801 | A1 * | 4/2010 | Li et al. | 83/13 |
| 2010/0089645 | A1 * | 4/2010 | Trinh et al. | 175/50 |
| 2010/0270085 | A1 * | 10/2010 | Turner et al. | 175/381 |
| 2010/0326731 | A1 | 12/2010 | Swietlik et al. | |
| 2011/0168446 | A1 | 7/2011 | Lemenager et al. | |
| 2011/0253448 | A1 * | 10/2011 | Trinh et al. | 175/50 |
| 2011/0266054 | A1 | 11/2011 | Kumar et al. | |
| 2011/0266055 | A1 * | 11/2011 | DiGiovanni et al. | 175/50 |
| 2011/0266058 | A1 * | 11/2011 | Kumar et al. | 175/57 |
| 2012/0132468 | A1 * | 5/2012 | Scott et al. | 175/50 |
| 2012/0312599 | A1 * | 12/2012 | Trinh et al. | 175/57 |
| 2012/0325564 | A1 * | 12/2012 | Vaughn et al. | 175/428 |
| 2013/0068525 | A1 * | 3/2013 | DiGiovanni | 175/40 |

OTHER PUBLICATIONS

Zhang, X., et al., "Design, Fabrication, and Characterization of Metal Embedded Microphotonic Sensors," Jnl. Manuf. Sci. Eng., vol. 130, No. 3, 031104 (2008).

Cheng, X. et al., "Development of Metal Embedded Microsensors by Diffusion Bonding and Testing in Milling Process," Jnl. Manuf. Sci. Eng., vol. 130, No. 6, 061010 (2008).

* cited by examiner

APPARATUS AND METHODS FOR DETECTING PERFORMANCE DATA IN AN EARTH-BORING DRILLING TOOL

CROSS-REFERENCES TO RELATED APPLICATIONS

This application claims priority from U.S. provisional patent application Ser. No. 61/408,119 filed on Oct. 29, 2010; U.S. provisional patent application Ser. No. 61/408,106 filed on Oct. 29, 2010; U.S. provisional patent application Ser. No. 61/328,782 filed on Apr. 28, 2010; and U.S. provisional patent application Ser. No. 61/408,144 filed on Oct. 29, 2010.

BACKGROUND OF THE DISCLOSURE

Field of the Disclosure

The present disclosure generally relates to earth-boring drill bits, cutting elements attached thereto, and other tools that may be used to drill subterranean formations. More particularly, embodiments of the present disclosure relate to obtaining diagnostic measurements of components of an earth-boring drill bit.

BACKGROUND

The oil and gas industry expends sizable sums to design cutting tools, such as downhole drill bits including roller cone rock bits and fixed cutter bits, which have relatively long service lives, with relatively infrequent failure. In particular, considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations.

Diagnostic information (e.g., temperature) related to a drill bit and certain components of the drill bit may be linked to the durability, performance, and the potential failure of the drill bit. For example, obtaining thermal measurements of a cutting element has been conventionally constrained to the use of one or more embedded thermocouples within the cutting element. The embedded thermocouples may be relatively large and may require careful implementation and placement of partially drilled holes through the substrate and into the diamond table adjacent the cutting surface of a cutting element. The drilled portions through the substrate and diamond table for housing the thermocouples may compromise the mechanical strength of the cutter.

Thermocouples may also require the use of relatively large voltage drivers, which may limit the downhole usefulness in obtaining accurate and representative temperature measurements during actual rock cutting during a subterranean drilling operation or, at the least, in a drilling simulator. As a result of these and other issues, conventional thermal measurements have been limited to laboratory experiments rather than obtaining real-time performance data during rock cutting.

In view of the above, the inventors have appreciated a need in the art for improved apparatuses and methods for obtaining measurements related to the diagnostic and actual performance of a cutting element of an earth-boring tool. More particularly, there is a need in the art for improved apparatuses and methods of performance measurements of a cutting element during drill bit operations.

BRIEF SUMMARY OF THE DISCLOSURE

In one embodiment, a cutting element of an earth-boring drilling tool is disclosed. The cutting element comprises a substrate with a cutting surface thereon, at least one thermistor sensor coupled with the cutting surface, and a conductive pathway operably coupled with the at least one thermistor sensor. The at least one thermistor sensor is configured to vary a resistance in response to a change in temperature. The conductive pathway is configured to provide a current path through the at least one thermistor sensor in response to a voltage.

Another embodiment comprises a method for forming a cutting element for an earth-boring drilling tool. The method comprises forming a substrate with a cutting surface on an external portion of the substrate, disposing an amount of a thermistor material on the cutting surface to form a thermistor sensor, and disposing a conductive pathway on the cutting surface coupling the thermistor sensor with the conductive pathway.

Another embodiment comprises a method for measuring temperature of a component of an earth-boring drilling tool. The method comprises applying a voltage to a thermistor material coupled with a component of the earth-boring tool, generating a current through the thermistor material responsive to the voltage, wherein the current varies with a temperature of the thermistor material, measuring the current, and determining the temperature of the component in response to the current measured through the thermistor material.

Yet another embodiment comprises an earth-boring drilling tool. The earth-boring drilling tool comprises a bit body including a plurality of components, and a thermistor sensor coupled with a least one of the bit body and a component of the plurality. The thermistor sensor is configured for generating performance data related to the earth-boring drilling tool during a drilling operation.

These features, advantages, and alternative aspects of the present disclosure will be apparent to those skilled in the art from a consideration of the following detailed description taken in combination with the accompanying drawings.

BRIEF DESCRIPTION OF THE SEVERAL VIEWS OF THE DRAWINGS

While the specification concludes with claims particularly pointing out and distinctly claiming that which is regarded as the present disclosure, the advantages of this disclosure may be more readily ascertained from the following description of the disclosure when read in conjunction with the accompanying drawings in which:

DETAILED DESCRIPTION OF THE DISCLOSURE

The illustrations presented herein are not meant to be actual views of any particular material, apparatus, system, or method, but are merely idealized representations which are employed to describe the present disclosure. Additionally, elements common between figures may have a similar numerical designation.

As used herein, a "drill bit" means and includes any type of bit or tool used for drilling during the formation or enlargement of a wellbore in subterranean formations and includes, for example, fixed cutter bits, rotary drill bits, percussion bits, core bits, eccentric bits, bi-center bits, reamers, mills, drag bits, roller cone bits, hybrid bits and other drilling bits and tools known in the art.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "hard material" means and includes any material having a Knoop hardness value of about 3,000 $Kg/mm^2$ (29,420 MPa) or more. Hard materials include, for example, diamond and cubic boron nitride.

Figure 1:
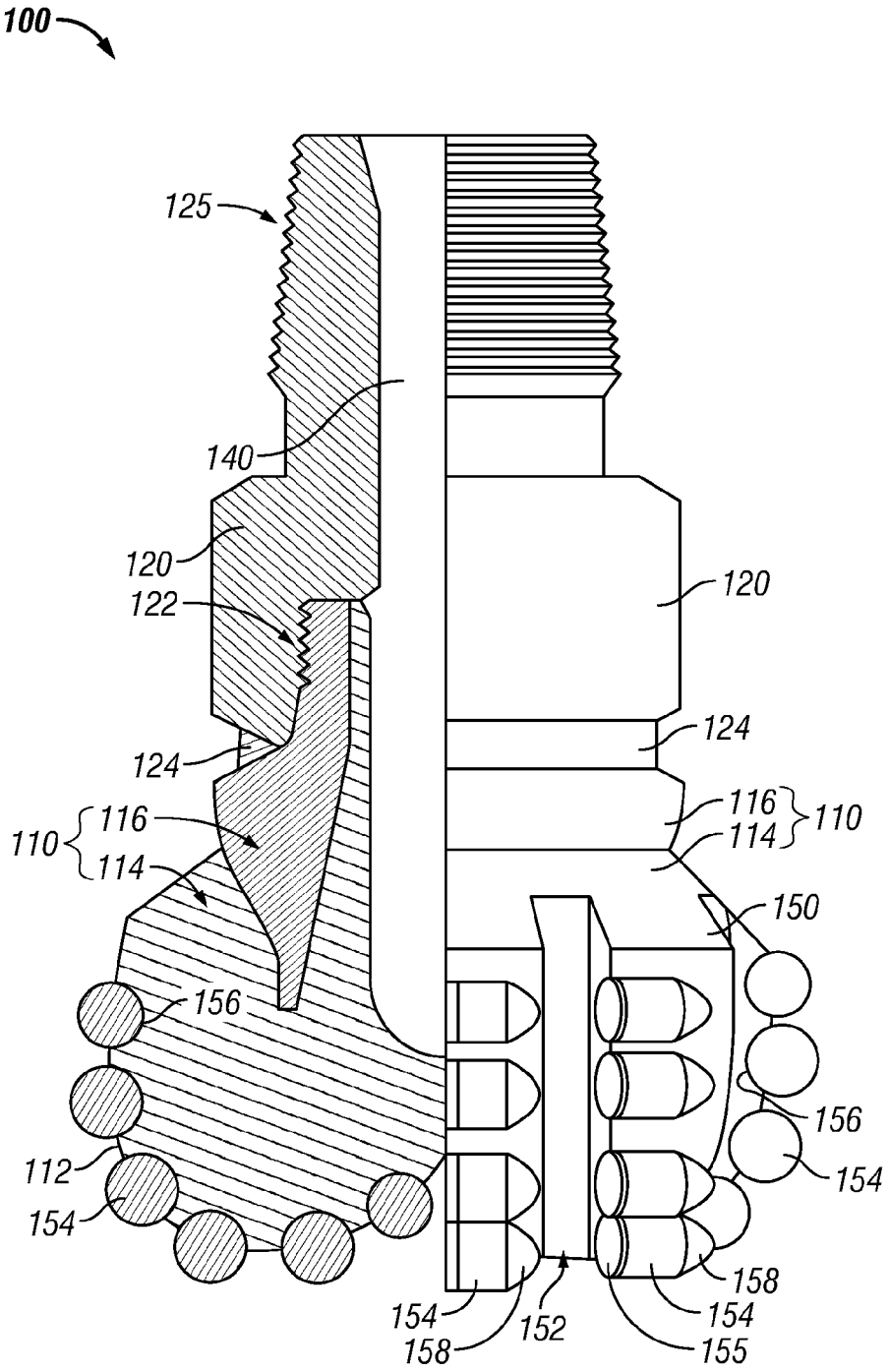
FIG. 1 illustrates a cross-sectional view of an exemplary earth-boring drill bit.

FIG. 1 illustrates a cross-sectional view of an exemplary earth-boring drill bit 100. Earth-boring drill bit 100 includes a bit body 110. The bit body 110 of an earth-boring drill bit 100 may be formed from steel. Alternatively, the bit body 110 may be formed from a particle-matrix composite material.

The earth-boring drill bit 100 may include a plurality of cutting elements 154 attached to the face 112 of the bit body 110. Generally, the cutting elements 154 of a fixed-cutter type drill bit have either a disk shape or a substantially cylindrical shape. A cutting element 154 includes a cutting surface 155 located on a substantially circular end surface of the cutting element 154. The cutting surface 154 may be formed by disposing a hard, super-abrasive material, such as mutually bound particles of polycrystalline diamond formed into a diamond table under high pressure, high temperature conditions, on a supporting substrate. Conventionally, the diamond table may be formed onto the substrate during the high pressure, high temperature process, or may be bonded to the substrate thereafter. Such cutting elements 154 are often referred to as a polycrystalline compact or a "polycrystalline diamond compact" (PDC) cutting element 154. The cutting elements 154 may be provided along the blades 150 within pockets 156 formed in the face 112 of the bit body 110, and may be supported from behind by buttresses 158, which may be integrally formed with the crown 114 of the bit body 110. Cutting elements 154 may be fabricated separately from the bit body 110 and secured within the pockets 156 formed in the outer surface of the bit body 110. If the cutting elements 154 are formed separately from the bit body 110, a bonding material (e.g., adhesive, braze alloy, etc.) may be used to secure the cutting elements 154 to the bit body 110.

The bit body 110 may further include wings or blades 150 that are separated by junk slots 152. Internal fluid passageways (not shown) extend between the face 112 of the bit body 110 and a longitudinal bore 140, which extends through the steel shank 120 and partially through the bit body 110. Nozzle inserts (not shown) also may be provided at the face 112 of the bit body 110 within the internal fluid passageways.

The earth-boring drill bit 100 may be secured to the end of a drill string (not shown), which may include tubular pipe and equipment segments coupled end to end between the earth-boring drill bit 100 and other drilling equipment at the surface of the formation to be drilled. As one example, the earth-boring drill by 100 may be secured to the drill string with the bit body 110 being secured to a steel shank 120 having a threaded connection portion 125 and engaging with a threaded connection portion of the drill string. An example of such a threaded connection portion is an American Petroleum Institute (API) threaded connection portion. The bit body 110 may further include a crown 114 and a steel blank 116. The steel blank 116 is partially embedded in the crown 114. The crown 114 may include a particle-matrix composite material such as, for example, particles of tungsten carbide embedded in a copper alloy matrix material. The bit body 110 may be secured to the shank 120 by way of a threaded connection 122 and a weld 124 extending around the drill bit 100 on an exterior surface thereof along an interface between the bit body 110 and the steel shank 120. Other methods for securing the bit body 110 to the steel shank 120 exist.

During drilling operations, the drill bit 100 is positioned at the bottom of a well bore hole such that the cutting elements 154 are adjacent the earth formation to be drilled. Equipment such as a rotary table or top drive may be used for rotating the drill string and the drill bit 100 within the bore hole. Alternatively, the shank 120 of the drill bit 100 may be coupled directly to the drive shaft of a down-hole motor, which then may be used to rotate the drill bit 100. As the drill bit 100 is rotated, drilling fluid is pumped to the face 112 of the bit body 110 through the longitudinal bore 140 and the internal fluid passageways (not shown). Rotation of the drill bit 100 causes the cutting elements 154 to scrape across and shear away the surface of the underlying formation. The formation cuttings mix with, and are suspended within, the drilling fluid and pass through the junk slots 152 and the annular space between the well bore hole and the drill string to the surface of the earth formation.

When the cutting elements scrape across and shear away the surface of the underlying formation, a significant amount of heat and mechanical stress may be generated. Components of the drill bit 100 (e.g., cutting elements 154) may be configured for detection of performance data during drilling operations, as will be discussed herein with respect to FIGS. 2-5. For example, embodiments of the present disclosure may include materials coupled with one or more cutting elements 154 of an earth-boring drill bit 100. The materials may be used to obtain real-time data related to the performance of the cutting element 154, such as thermal and mechanical (e.g., stresses and pressures) data. Diagnostic information related to the actual performance of the drill bit 110 may be obtained through analysis of certain properties of the materials. In some embodiments of the present disclosure, each cutting element 154 of the drill bit 100 may be configured to provide such data. Although cutting elements 154 are illustrated and described herein as exemplary, embodiments of the present disclosure may include other components within the drill bit 100 being configured for obtaining diagnostic information related to the actual performance of the drill bit 100.

Figure 2A:
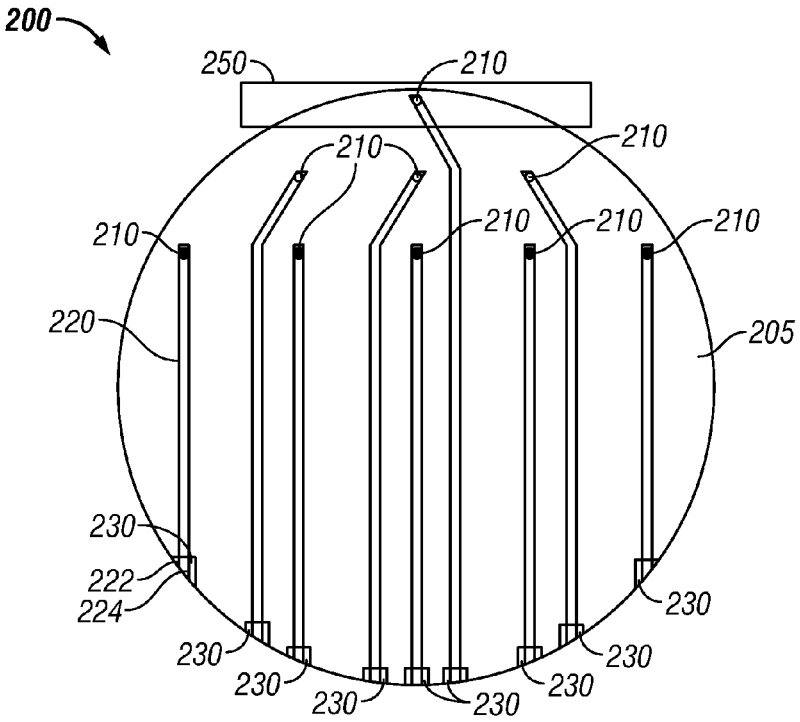
FIGS. 2A and 2B illustrate a cutting element according to an embodiment of the present disclosure.
Figure 2B:
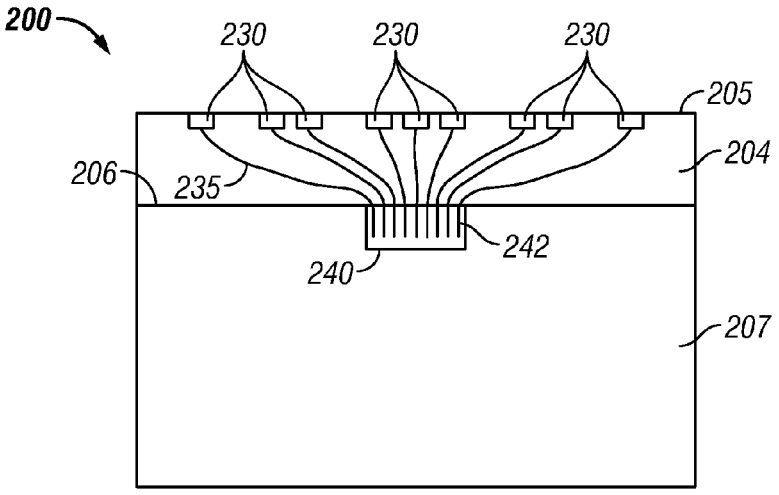

FIGS. 2A and 2B illustrate a cutting element 200 according to an embodiment of the present disclosure. Cutting element 200 may be included in an earth-boring drill bit, such as, for example an earth-boring drill bit similar to the one described in reference to FIG. 1. As shown in FIG. 2A, cutting element 200 includes one or more sensors 210, conductive paths 220, and terminations 230. Sensors 210 may be formed from a thermistor material, and may be referred to as a thermistor sensor 210. Each thermistor sensor 210 is operably coupled to a corresponding termination 230 through a conductive path 220.

The thermistor sensors 210 may be configured for providing temperature measurements during the rock cutting process. Thermistor sensors 210 may comprise at least one of a variety of thermistor materials that may be sensitive to a temperature of the cutting element 200. Thermistor materials may include any material having an electrical resistivity which varies as a function of its temperature sufficiently to enable suitable measurement of the temperature. Thermistor materials may be categorized into two classes, positive temperature coefficient (PTC) and negative temperature coefficient (NTC) materials.

Thermistor sensors 210 may be operably coupled with terminations 230 through conductive pathways 220. Terminations 230 are configured to receive a voltage signal, which is applied across ends 222, 224 of the conductive pathway 220. Thus, a continuous path is formed from one end (e.g., 222) of the conductive pathway 220 to the other end (e.g., 224) of the conductive pathway 220 through the thermistor sensor 210. Data may also be read at the terminations 230. The terminations 230 may be conveniently located proximate a periphery of the cutting element 200 in order to carry an analog data signal from the thermistor sensors 210 away from the cutting element 200 to a data acquisition module (not shown).

In operation, a voltage may be applied to the terminations 230. As a result of the continuous path, when a voltage is applied, a closed circuit is formed, and current flows through the thermistor sensors 210 through conductive pathways 220. Because the thermistor sensors 210 include a thermistor material, the resistance of the thermistor sensors 210 may vary with a change in temperature. As a result, the current drawn by the thermistor sensor 210 may be measured at the terminations 230 by a data acquisition module and converted to a corresponding temperature based on the known properties of the thermistor materials in the thermistor sensors 210.

Examples of thermistor materials which may be used to form a thermistor sensor 210 may include semiconducting materials (e.g., semiconductors with the spinel structure). Certain semiconductor materials may be configured as a thermistor material for particular applications by controlling the material chemistry of the semiconductor material. For example, a thermistor may be formed by controlling the ratio of conducting to non-conducting components in the semiconductor material. Examples of such semiconductor materials may include $Zn_2TiO_4$, $MgCr_2O_4$, and $MgAl_2O_4$. Other thermistor materials may be used, including those based on semiconducting materials such as silicon and germanium.

Another example of a thermistor material suitable for a thermistor sensor 210 may include a doped diamond material. An example of a possible dopant may include boron; however, other dopants may be used. Due to the harsh and abrasive environment during drilling operations, it may be desirable to have a thermistor material with a relative hardness and/or toughness. For example, using a diamond based material as a thermistor material may be desirable as other thermistor materials may be relatively soft, especially relative to diamond. Additionally, as diamond is often be used as a material in cutting elements 200 (e.g., PDC cutting elements), using a diamond based material as a thermistor material may improve the matching of the coefficient of thermal expansion (CTE) for the thermistor material to that of the material used to form the cutting surface 205 of cutting element 200. Improving the matching of CTE may decrease residual stresses in the materials and promote the successful deposition and adherence of the thermistor material with the cutting element 200.

The thermistor materials may be deposited on the cutting surface 205 of the cutting element 200 to form thermistor sensors 210 through conventional masking and patterning techniques as are known by those of ordinary skill in the art. The thermistor sensors 210 may be positioned at various locations on the cutting surface 205 of a cutting element 200. For example, in FIG. 2A, the thermistor sensors 210 of cutting element 200 are arranged in an orthogonal grid configuration, in which at least one of the grid axes is aligned parallel (e.g., horizontal axis in FIG. 2A) to the anticipated cutting direction. The thermistor sensors 210 may be positioned in other patterns (e.g., circular configuration of FIGS. 3A and 3B), or even randomly dispersed on the cutting surface 205 of the cutting element 200 in order to obtain various desired temperature profiles of the cutting element 200.

During a drilling operation, cutting element 200 may experience wear when engaging with a rock formation. Wear region 250 represents an area for estimated wear of the cutting element 200 during the rock cutting process. Due to the friction with rock during drilling operations, the areas of the cutting element 200 proximate the wear region 250 may experience a temperature increase before other regions of the cutting element 200. As shown in FIG. 2A, the thermistor sensors 210 may be positioned proximate the wear region 250. One or more thermistor sensors 210 may be positioned within the wear region 250. As a result, one or more thermistor sensors 210 may be damaged or completely removed from the cutting element 200 when the wear region 250 is removed. Thus, additional thermistor sensors 210 may be employed for redundancy in case of damage or other failure of one or more thermistor sensors 210.

The conductive pathways 220 may be formed from an electrically conductive material sufficient to activate the thermistor sensors 210 upon application of a voltage. For example, the material used to form conductive pathways 220 may be the same material used to form the thermistor sensors 210. The terminations 230 may also formed from a conductive material (e.g., metal, metal alloy, etc.).

While FIG. 2A illustrates thermistor sensors 210 positioned in the upper portion of the face of the cutting element 200 (i.e., within, or proximate, the wear region 250), embodiments of the present disclosure are not so limited. For example, thermistor sensors 210 may be located at any location of the cutting element, including areas in the lower portion of the face of the cutting element 200 (i.e., away from the wear region 250). Thus, additional thermistor sensors 210 may also be employed for obtaining a temperature profile of different areas of the cutting element 200.

FIG. 2B illustrates a side view of a cutting element 200 according to an embodiment of the present disclosure. Cutting element 200 may include a substrate 207 and a cutting surface 205. As previously discussed, for PDC cutting elements the cutting surface 205 may be formed from a PDC. In such an embodiment, the cutting surface 205 may be the surface (i.e., face) of the diamond table 204. For some cutting elements 200, the substrate 207 and the cutting surface 205 may be integrally formed from the same material.

As previously described, the thermistor sensors 210, conductive pathways 220, and terminations 230 may be deposited on the cutting surface 205 of the cutting element 200. Alternatively, the thermistor sensors 210, conductive pathways 220, and terminations 230 may be at least partially embedded within the cutting surface 205 of cutting element 200. For example, FIG. 2B shows the metal terminations 230 at least partially embedded within the cutting surface 205 of the cutting element 200. Embedding may be accomplished by forming depressions (e.g., grooves, trenches) in the cutting surface 205 and depositing the appropriate materials for the thermistor sensors 210, conductive pathways 220, and terminations 230 within the depressions. Depositing the appropriate materials within the depressions may result in the thermistor sensors 210, conductive pathways 220, and terminations 230 forming a substantially smooth (i.e., flush) surface with the outer face, or cutting face, of the cutting surface 205. Forming the depressions may be accomplished during formation of the cutting element 200 or through machining, such as electro-discharge machining, or EDM, laser etching or machining, or other similar techniques as known by those of ordinary skill in the art, after formation of the cutting element 200. One or more thermistor sensors 210, conductive pathways 220, and terminations 230 may be positioned at other locations of the cutting element 200, such as, for example, on or within the substrate 207, at the interface 206 between the cutting surface 205 and the substrate 207, among other possible locations.

FIG. 2B also illustrates that the terminations 230 may be coupled to a port 240, which may include a plurality of channels 242 for communication of data signals to a data collection module (not shown). The terminations 230 may operably couple to the port 240 with conductive elements 235 (e.g., electrical wiring, patterned metallization). Conductive elements 235 may extend along the surface of the cutting element 200, or be at least partially buried (i.e., embedded) within the cutting element 200. Because of durability concerns it may be desirable to include encapsulation of the conductive elements 235, for example, by diamond, diamond-like carbon, boron carbide, boron nitride, silicon nitride, $AlMgB_{14}$ or $AlMgB_{14}$+$TiB_2$ (also known as BAM nanoceramics), metals, ceramics, refractory metals, thermally sprayed composites, or combinations thereof. It is noted that conductive elements 235 are shown as single lines for simplicity, but such each of conductive elements 235 may include two-way conductive paths.

In operation, the port 240 may receive data signals from the thermistor sensors 210 through conductive pathways 220, terminations 230, and conductive elements 235, and transmit the data signals to a data collection module. The data collection module may include components such as, for example, an analog-to-digital converter, analysis hardware/software, displays, and other components for collecting and/or interpreting data generated by the thermistor sensors 210. Such data transmission from the port 240 to the data acquisition module may include wired or wireless communication.

Port 240 may be common to each of the terminations 230 with a channel 242 corresponding to each termination 230, as is shown in FIG. 2B; however, a cutting element 200 may include a plurality of ports, wherein one or more ports of the plurality of ports receives data from a subset of thermistor sensors 210 rather than being common to the entire group of thermistor sensors 210. Additionally, port 240 is shown in FIG. 2B as being located within the substrate 207 and below the cutting surface 205; however, one of ordinary skill in the art will appreciate that port 240 may be located in any number of locations, such as at or proximate the bottom portion of the substrate 207, partially or entirely within the cutting surface 205, or in some embodiments external to the cutting element 200.

Port 240, conductive elements 240, or both, may be interfaced with a processing module within the drill bit itself. For example, some earth-boring drill bits including such a processing module may be termed a "Data Bit" module-equipped bit, which may include electronics for obtaining and processing data related to the bit and the bit frame, such as is described in U.S. Pat. No. 7,604,072 which issued Oct. 20, 2008 and entitled Method and Apparatus for Collecting Drill Bit Performance Data, the entire disclosure of which is incorporated herein by this reference.

Figure 3A:
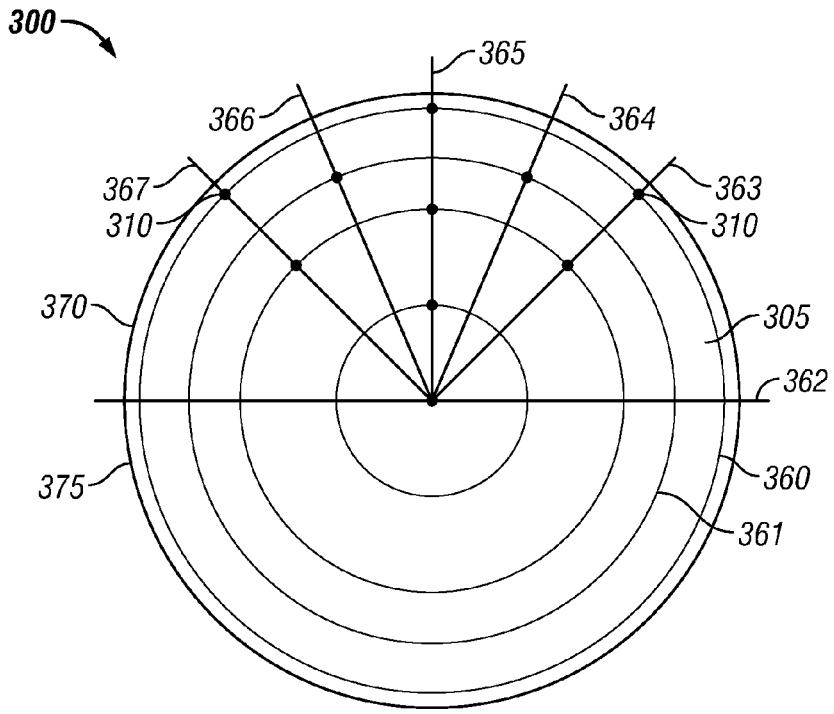
FIGS. 3A and 3B illustrate a cutting element according to another embodiment of the present disclosure.
Figure 3B:
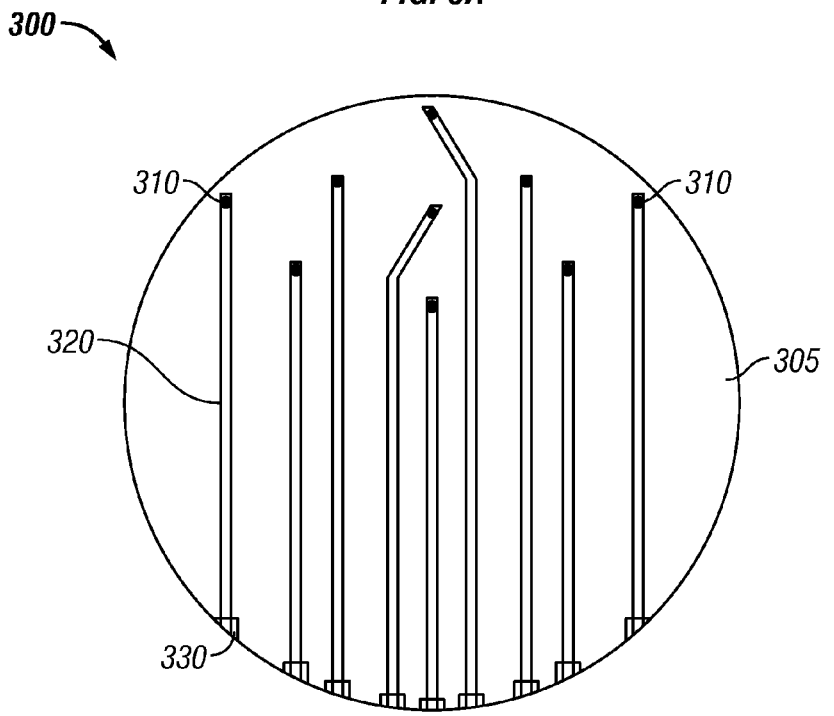

FIGS. 3A and 3B illustrate a cutting element 300 according to another embodiment of the present disclosure, which cutting element 300 may be used in an earth-boring drill bit. For example, FIG. 3A shows a potential placement pattern for thermistor sensors 310 associated with the surface 305 of cutting element 300. Placement reference lines 360-367 are shown to illustrate one contemplated placement of thermistor sensors 310 in relation to each other, and are not intended to represent any physical feature of cutting element 300. Other circular placement lines are shown for the same purpose; however, these other circular placement reference lines are not numbered in order not to obscure the figure.

FIG. 3B illustrates the placement of thermistor sensors 310 of cutting element 300 of FIG. 3A without placement reference lines 360-367. FIG. 3B further illustrates the thermistor sensors 310 being operably coupled to corresponding terminations 330 through conductive pathways 320. Although the number of thermistor sensors 310 is shown in the various examples (FIGS. 2-3) is shown to be nine, it is recognized that a cutting element 300 may include more or fewer thermistor sensors 310.

As previously described, the thermistor sensors 310 may be located at any location of the cutting element 300. For example, the number and locations of the thermistor sensors 310 may be chosen so as to model the thermal diffusivity of the cutting element 300 (i.e., how the thermal properties diffuse across the cutting element 300).

In operation, each data signal generated by the thermistor sensors 310 may be viewed by a data acquisition module individually and/or collectively, in order to analyze the temperature of the cutting element 300 as the temperature diffuses across the cutting element 300 in a distributed way. In other words, each thermistor sensor 310 may detect a different temperature over a given time, such that a thermal model may be reconstructed to model the thermal diffusivity of the cutting element 300 during drilling operations.

Figure 4:
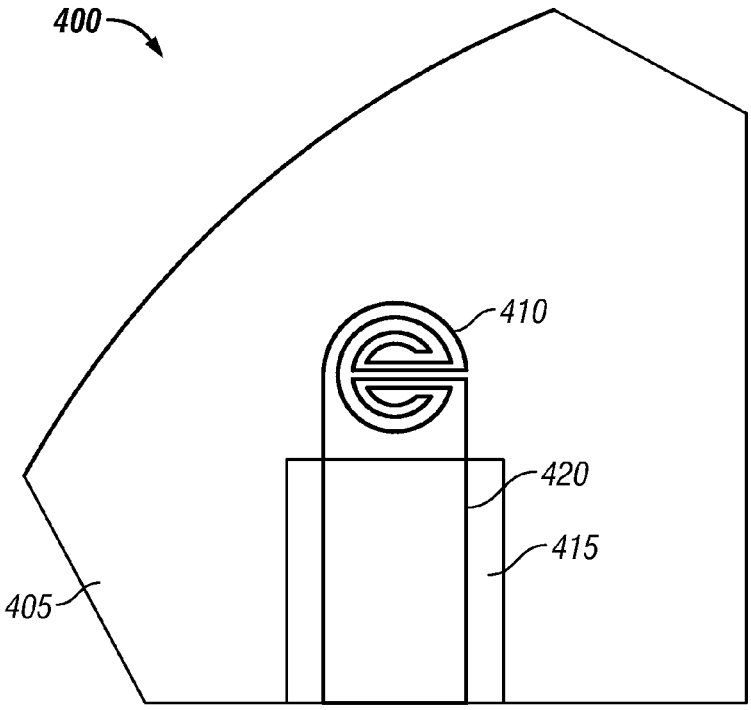
FIG. 4 illustrates zoomed-in view of a cutting element according to an embodiment of the present disclosure.

FIG. 4 illustrates a zoomed-in, greatly enlarged view of a cutting element 400 according to an embodiment of the present disclosure. Cutting element 400 may be used in an earth-boring drill bit. Cutting element 400 includes a thermistor sensor 410 and conductive pathway 420 disposed on a cutting surface 405 of the cutting element 400.

Cutting element 400 may further include an insulating layer 415 disposed between at least a portion of the conductive pathway 420 and the cutting surface 405 of the cutting element 405. Insulating layer 415 may extend along the conductive pathway 420 to the termination (FIGS. 2 and 3). Insulating layer 415 may be configured to isolate the conductive pathway 420 from the thermal flux through the cutting surface 405. Insulating layer 415 may include a thermally insulating material with a lower thermal conductivity relative to the material chosen for the conductive pathway 420. Examples of suitable materials for insulating layer 415 include zirconium oxide, aluminum oxide, mullite, glass and silicon carbide.

Figure 5A:
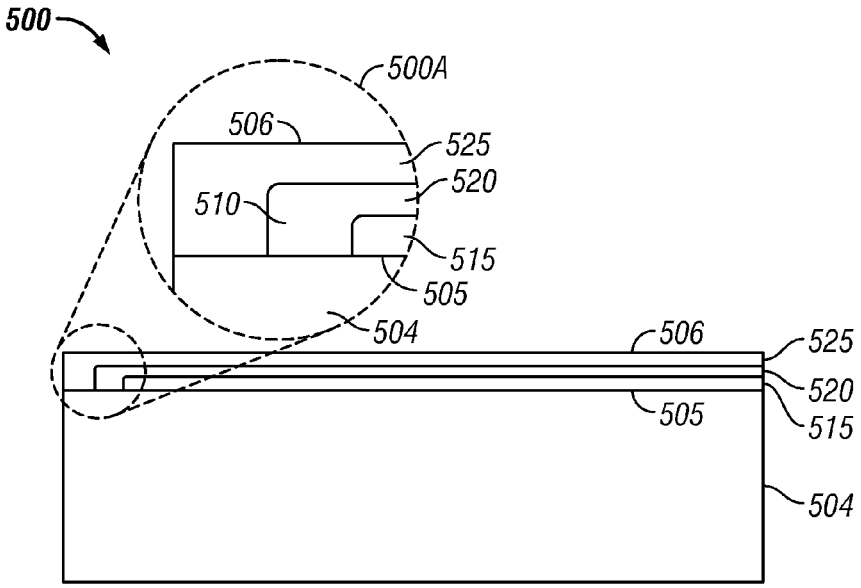
FIGS. 5A and 5B each illustrate respective cross-sectional side views of a cutting element according to an embodiment of the present disclosure.

The thermistor sensor 410 is shown with a particular pattern at its distal end configured to lengthen the current path through the thermistor sensor 410. For example, it may be desirable to lengthen the current path through the thermistor sensor 410 in order to increase the sensitivity of the thermistor material and improve the experienced signal to noise ratio. In other words, a desirable characteristic of the thermistor sensor 410 may be to have a relatively long current path in a relatively small area. However, embodiments of the disclosure may not be so limited, and longer or shorter length and larger smaller and larger diameters of area covered for thermistor sensors 410 are contemplated. Other patterns for the thermistor sensor 410 may exist, including a uniform dot FIGS. 5A and 5B each illustrate respective cross-sectional side views of a cutting element 500, 500' according to an embodiment of the present disclosure. For example, FIG. 5A shows a thermistor 510 applied to the cutting surface 505 of cutting element 500. Cutting surface 505 may be the surface (i.e., face) of a diamond table 504. Thermistor sensor 510 is operably coupled with a conductive pathway 520, which may further couple to a termination (see, e.g., FIGS. 2-3). The conductive pathway 520 and the thermistor sensor 510 may be formed from the same material. The cutting element 500 may further include an insulating layer 515 disposed between the cutting surface 505 of the cutting element 500 and at least a portion of the conductive pathway 520. The insulating layer 515 may extend along the entire conductive pathway 520 to the termination (FIGS. 2 and 3).

Cutting element 500, may further include a hardened layer 525 disposed over the thermistor sensor 510 and conductive pathway 520, such that the surface (i.e., face) of the hardened layer 525 becomes the new cutting surface 506. As previously described, during a drilling operation of an earth-boring drill bit, rock cutting and the drilling environment may wear upon the face of the cutting element 500. The wear upon the face of the cutting element 500 may damage other materials that may be deposited on the surface of the cutting element, such as many thermistor materials that may be used in embodiments of the present disclosure. For example, the materials used for layers 510, 520, 515 may be removed by abrasion, chipping, or flaking off during operation. Therefore, it may be desirable to dispose the hardened layer 525 to the exterior surface of the thermistor sensor 510. For example, the entire cutting surface 505 of cutting element 500 may have hardened layer 525 disposed thereon, including over the thermistor sensors 510, conductive pathways 520, insulating layer 515, portions of the surface of cutting element 500 that are exposed, or any combination thereof. The hardened layer 525 may include a diamond film or other hard material. The hardened layer 525 may be applied by chemical vapor deposition (CVD), physical vapor deposition (PVD), or other deposition techniques known to those of ordinary skill in art.

As previously described, layers 510, 520, 515 may be disposed on a cutting surface 505 of the cutting element 500. Layers 510, 520, 515 may also be at least partially embedded within depressions (e.g., grooves, trenches) formed in the cutting surface 505 (e.g., in the diamond table 504) of the cutting element 500. For example, layers 510, 520, 515 may be deposited within the depressions such that layers 510, 520, 515 may form a substantially smooth (i.e., flush) surface with the cutting surface 505. A cutting element with one or more embedded layers 510, 520, 515 may also include hardened layer 525 disposed thereon.

Figure 5B:
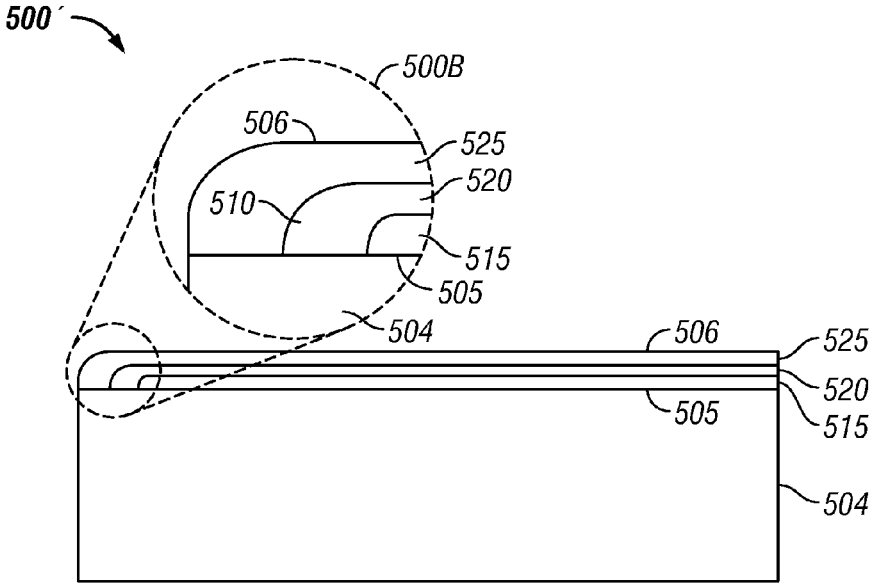

Likewise, in FIG. 5B, cutting element 500' may include thermistor sensor 510, conductive pathway 520, insulating layer 515, and hardened layer 525 configured as before with respect to FIG. 5A; however, in FIG. 5B the various layers (510, 520, 515, 525) of cutting element have rounded edges 500B rather than the edges 500A comprising substantially distinct corners illustrated in FIG. 5A. Rounded edges 500B may be desirable from a stress concentration standpoint. The rounded edges 500B may be formed either as materials are deposited or through post-deposition processing.

Cutting elements 500, 500' may further include one or more additional layers (not shown) located below or between the layers described herein in order promote deposition and/or adhesion of one material to another in formation of the layered structures.

It is noted that the relative thicknesses of the different layers of FIGS. 5A and 5B may not be to scale. Thus, the relative thicknesses may vary. For example, the thermistor sensor 510, and conductive pathway 520 layers may comprise a relatively thin film of thermistor materials. Additionally, it may be desirable for the hardened layer 525 to be relatively thick in comparison to the other layers.

Another embodiment of the present disclosure may include a cutting element with thermistor sensors as described herein, and further including embedded thermocouples within the cutting surface and/or the substrate.

Another embodiment of the present disclosure may include the thermistor sensor being configured as a micro-electro-mechanical system (MEMS) device, which MEMS device may include one or more elements integrated on a common substrate. Such elements may include sensors, actuators, electronic and mechanical elements. The MEMS device may comprise a thermistor material, such as diamond. The MEMS device may be configured to detect temperature or mechanical properties (e.g., pressure) of the cutting element. The MEMS device may be operably coupled with conductive pathways. Such an embodiment including one or more MEMS device may also include insulating layers and hardened layers as described herein.

The present disclosure has been made with respect to the use of the thermistor on the cutting element. This is not to be construed as a limitation and other types of sensors could also be used. These could include a sensor configured to generate information relating to (i) a pressure associated with the drill bit, (ii) a strain associated with the drill bit; (iii) a formation parameter, and (iv) vibration. Each of the sensor types generates information relating to the parameter of interest when the cutting element is drilling a borehole. Sensors may be disposed on two cutting elements and used to measure a property of material (cuttings) from the earth formation between the two cutting elements.

Although the foregoing description contains many specifics, these are not to be construed as limiting the scope of the present disclosure, but merely as providing certain exemplary embodiments. Similarly, other embodiments of the disclosure may be devised which do not depart from the scope of the present disclosure.

What is claimed is:

1. A cutting element for an earth-boring drilling tool, the cutting element comprising:

a substrate with a cutting surface thereon;

at least one thermistor sensor coupled with the cutting surface, the at least one thermistor sensor configured to generate an output in response to a change in temperature relating to a parameter of interest of the cutting element when the cutting element is drilling a borehole.

2. The cutting element of claim 1, wherein the at least one thermistor sensor is configured to vary a resistance in response to a change in temperature; and wherein the cutting element further comprises a conductive pathway operably coupled with the at least one thermistor sensor, the conductive pathway configured to provide a current path through the at least one thermistor sensor in response to a voltage.

3. The cutting element of claim 2, further comprising a termination operably coupled with the at least one thermistor sensor through the conductive pathway, the termination configured to transmit temperature data from the at least one thermistor sensor to a data acquisition module.

4. The cutting element of claim 2, further comprising an insulating layer located between at least a portion of the conductive pathway and the cutting surface.

5. The cutting element of claim 2, further comprising a hardened layer disposed on the cutting surface, wherein the hardened layer covers at least a portion of the at least one thermistor sensor and the conductive pathway.

6. The cutting element of claim 2, wherein the at least one thermistor sensor is configured as a micro-electro-mechanical system (MEMS) device including a thermistor material.

7. The cutting element of claim 1, wherein the thermistor sensor includes a doped diamond material.

8. A method for forming a cutting element for an earth-boring drilling tool, the method comprising:

forming a substrate with a cutting surface on an external portion of the substrate;

disposing an amount of a thermistor sensor material on the cutting surface to form a thermistor sensor; and disposing a conductive pathway on the cutting surface coupling the thermistor sensor with the conductive pathway.

9. The method of claim 8, wherein disposing the thermistor sensor material further comprises disposing a doped diamond material.

10. The method of claim 8, further comprising disposing an insulating material on the cutting surface before disposing the conductive pathway thereon.

11. The method of claim 8, wherein forming the substrate with the cutting surface includes forming depressions in the cutting surface such that disposing the amount of thermistor sensor material and the conductive pathway forms a smooth surface flush with a cutting face of the cutting surface.

12. A method for measuring a property of a cutting element of an earth-boring drilling tool, the method comprising:

coupling a thermistor sensor with a cutting surface of the cutting element of the earth-boring tool;

using the thermistor sensor to provide an output indicative of the property in response to a change in temperature relating to the property when the cutting element is drilling a borehole; and determining the property of the component in response to the output of the thermistor sensor.

13. The method of claim 12, wherein the property comprises a temperature.

14. An earth-boring drilling tool, comprising:

a bit body including a cutting element; and a thermistor sensor coupled with a cutting surface of the cutting element configured to generate performance data related to the cutting element in response to a change in temperature of the cutting element during a drilling operation.

15. The earth-boring drilling tool of claim 14, wherein the thermistor sensor is configured to generate temperature data.

16. The earth-boring drilling tool of claim 14, further comprising an additional sensor coupled to the bit body configured to provide temperature data related to the bit body during a drilling operation.

* * * * *